US011992916B2

(12) United States Patent
Rikiishi et al.

(10) Patent No.: US 11,992,916 B2
(45) Date of Patent: May 28, 2024

(54) FINE ADJUSTMENT THREAD ASSEMBLY AND PROCESSING APPARATUS

(71) Applicant: DISCO CORPORATION, Tokyo (JP)

(72) Inventors: Toshiyasu Rikiishi, Tokyo (JP); Kentaro Wada, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 711 days.

(21) Appl. No.: 17/181,104

(22) Filed: Feb. 22, 2021

(65) Prior Publication Data

US 2021/0268621 A1 Sep. 2, 2021

(30) Foreign Application Priority Data

Mar. 2, 2020 (JP) ..... 2020-034780

(51) Int. Cl.
*B24B 7/07* (2006.01)
*B24B 41/06* (2012.01)
*B24B 49/04* (2006.01)

(52) U.S. Cl.
CPC ..... *B24B 7/075* (2013.01); *B24B 41/06* (2013.01); *B24B 49/04* (2013.01)

(58) Field of Classification Search
CPC ..... B24B 7/075; B24B 7/228; B24B 27/0015; B24B 27/0084; B24B 37/005; B24B 37/04; B24B 37/10; B24B 37/12; B24B 37/20; B24B 37/34; B24B 41/002; B24B 41/005; B24B 41/04; B24B 41/042; B24B 41/044; B24B 41/047; B24B 41/053; B24B 41/06; B24B 45/00; B24B 45/003; B24B 49/04; B24B 49/16
USPC ..... 451/5, 9, 10, 11, 12, 14, 41, 280, 285, 451/287, 290
See application file for complete search history.

(56) References Cited

FOREIGN PATENT DOCUMENTS

JP 2003326456 A 11/2003
JP 2013119123 A 6/2013

*Primary Examiner* — Eric J Rosen
*Assistant Examiner* — Sharonda T Felton
(74) *Attorney, Agent, or Firm* — Greer Burns & Crain Ltd.

(57) ABSTRACT

A fine adjustment thread assembly couples a first part and a second part to each other while keeping the first part and the second part spaced apart, adjusts the distance between the first part and the second part, and detects a load applied to the second part. The assembly includes first external threads that can be brought into threaded engagement with first internal threads formed in the first part, second external threads that are axially spaced from the first external threads, that have a thread pitch different from that of the first internal thread, and that can be brought into threaded engagement with second internal threads formed in the second part. A joint portion between the first external threads and the second external threads houses a load sensor under a compressive load.

2 Claims, 4 Drawing Sheets

FINE ADJUSTMENT THREAD ASSEMBLY AND PROCESSING APPARATUS

BACKGROUND OF THE INVENTION

Field of the Invention

The present invention relates to a fine adjustment thread assembly and a processing apparatus.

Description of the Related Art

Some grinding apparatuses grind a workpiece held on a holding surface of a chuck table with an annular array of grindstones mounted on a grinding unit. In such a grinding apparatus, the chuck table and the grinding unit are positioned relatively to each other such that the grindstones pass through the center of the workpiece when the workpiece is ground by the grindstones on the grinding apparatus.

The workpiece held on the holding surface of the chuck table is ground in a radial area extending from the center to outer circumferential edge of the workpiece. In the radial area, the holding surface and the lower surfaces of the grindstones lie parallel to each other. Furthermore, the degree of parallelism between the holding surface and the lower surfaces of the grindstones is adjusted on the basis of a measured thickness of the workpiece being ground. Therefore, the grinding apparatus incorporates a tilt adjusting mechanism for adjusting the degree of parallelism between the holding surface and the lower surfaces of the grindstones.

The tilt adjusting mechanism tilts a spindle unit that is supported on a spindle support case for rotating the grindstones. Alternatively, the tilt adjusting mechanism tilts a chuck shaft unit that is supported on an apparatus base for rotating the chuck table.

Recent years have seen demands for shortened grinding times required to grind workpieces. To shorten a grinding time, the grindstones are pressed against a workpiece under an increased load when the grindstones grind the workpiece. If the load on the grindstones is too large, then a tape disposed between the workpiece and the holding surface is crushed, making it difficult to uniformize the thickness of the workpiece that has been ground.

Attempts have been made to uniformize the thickness of a ground workpiece by controlling the load applied to the grindstones on the basis of the load as measured when the workpiece is ground. In order to measure the load, a load sensor is interposed between the apparatus base and the chuck shaft unit or between the spindle support case and the spindle unit, i.e., between apparatus members, as disclosed in Japanese Patent Laid-open No. 2003-326456.

SUMMARY OF THE INVENTION

According to the arrangement disclosed in Japanese Patent Laid-open No. 2013-119123, when the tilt of the chuck shaft unit or the spindle unit is varied by the tilt adjusting mechanism, the distance between the apparatus members with the load sensor interposed therebetween is also varied. If the distance between the apparatus members is increased, then the load is less likely to be imposed on the load sensor and hence becomes difficult to be measured by the load sensor.

It is therefore an object of the present invention to provide a processing apparatus that is capable of appropriately measuring a load applied to a processing tool even after a tilt adjusting process has been carried out to adjust the degree of parallelism between the holding surface of a chuck table and the lower surface of the processing tool.

In accordance with an aspect of the present invention, there is provided a fine adjustment thread assembly for coupling a first part and a second part to each other while keeping the first part and the second part spaced apart from each other, adjusting a distance between the first part and the second part, and detecting a load applied to the second part, including first external threads that can be brought into threaded engagement with first internal threads formed in the first part, second external threads that are disposed on an extension of an axial direction of the first external threads and axially spaced from the first external threads, that have a thread pitch different from that of the first internal thread, and that can be brought into threaded engagement with second internal threads formed in the second part, a joint portion by which the first external threads and the second external threads that are spaced from each other are integrally joined to each other, and a load sensor housed in the joint portion under a compressive load.

In accordance with another aspect of the present invention, there is provided a processing apparatus including a holding unit for holding a workpiece on a holding surface thereof, a processing unit including a spindle and a processing tool mounted on the spindle, a vertically moving mechanism for moving a support case supporting the processing unit thereon in vertical directions perpendicular to the holding surface, and a processing unit tilt adjusting mechanism for adjusting a tilt of the processing unit with respect to the holding unit, in which the processing unit tilt adjusting mechanism includes a fine adjustment thread assembly for coupling a first part and a second part to each other while keeping the first part and the second part spaced apart from each other, adjusting a distance between the first part and the second part, and detecting a load applied to the second part, the fine adjustment thread assembly including first external threads that can be brought into threaded engagement with first internal threads formed in the first part, second external threads that are disposed on an extension of an axial direction of the first external threads and axially spaced from the first external threads, that have a thread pitch different from that of the first internal thread, and that can be brought into threaded engagement with second internal threads formed in the second part, a joint portion by which the first external threads and the second external threads that are spaced apart from each other are integrally joined to each other, and a load sensor housed in the joint portion under a compressive load, and the first part includes the support case and the second part includes the processing unit.

In accordance with a further aspect of the present invention, there is provided a processing apparatus including a holding unit for holding a workpiece on a holding surface thereof, a base supporting the holding unit thereon, a processing unit including a spindle and a processing tool mounted on the spindle, a vertically moving mechanism for moving a support case supporting the processing tool thereon in vertical directions perpendicular to the holding surface, and a holding unit tilt adjusting mechanism for adjusting a tilt of the holding unit with respect to the processing unit, in which the holding unit tilt adjusting mechanism includes a fine adjustment thread assembly for holding a first part and a second part while keeping the first part and the second part spaced apart from each other, adjusting a distance between the first part and the second part, and detecting a load applied to the second part, the fine adjustment thread assembly including first external threads that can be brought into threaded engagement with first internal threads formed in the first part, second external threads that are disposed on an extension of an axial direction of the first external threads and axially spaced from the first external threads, that have a thread pitch different from that of the first internal thread, and that can be brought into threaded engagement with second internal threads formed in the second part, a joint portion by which the first external threads and the second external threads that are spaced apart from each other are integrally joined to each other, and a load sensor housed in the joint portion under a compressive load, and the first part includes the base and the second part includes the holding unit.

The fine adjustment thread assembly according to the present invention is capable of adjusting the distance between the first part and the second part and detecting a load applied to the second part.

The processing apparatus according to the present invention is able to easily adjust the tilt of the holding unit and the processing unit with respect to each other by turning the fine adjustment thread assembly, thereby simply adjusting the degree of parallelism between the holding surface of the holding unit and the processing tool of the processing unit.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

Figure 1:
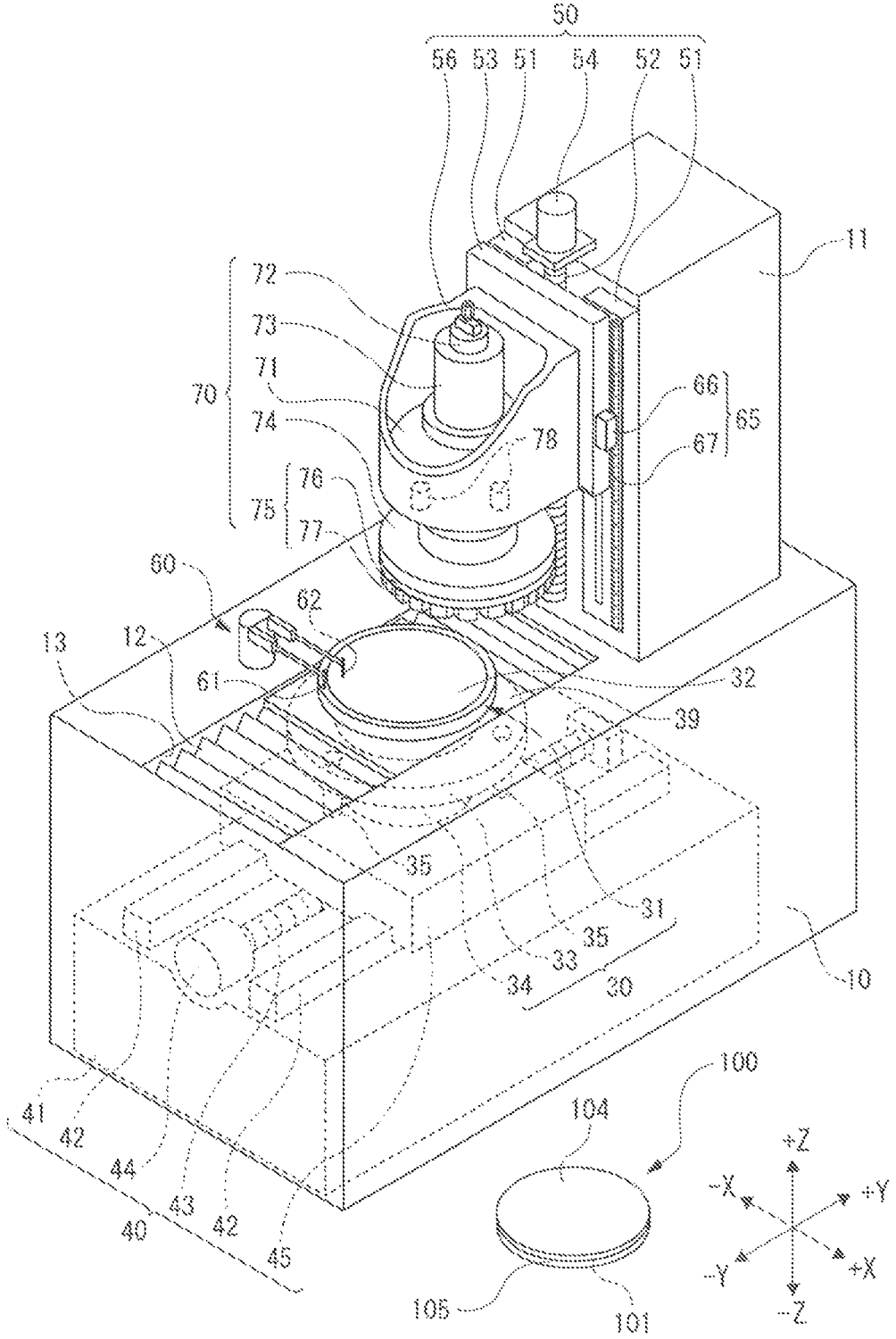
FIG. 1 is a perspective view of a grinding apparatus as a processing apparatus according to a preferred embodiment of the present invention.

As illustrated in FIG. 1, a grinding apparatus 1 as a processing apparatus according to a preferred embodiment of the present invention operates to grind a wafer 100 as a workpiece and includes a main casing 10 shaped as a rectangular parallelepiped and a column 11 extending upwardly from the main casing 10.

The wafer 100 may be a circular semiconductor wafer, for example. The wafer 100 has a face side 101 facing downwardly in FIG. 1 that has a plurality of devices formed thereon that are protected by a protective tape 105 affixed thereto. The wafer 100 is to be ground on a reverse side 104 thereof that is opposite the face side 101.

Figure 2:
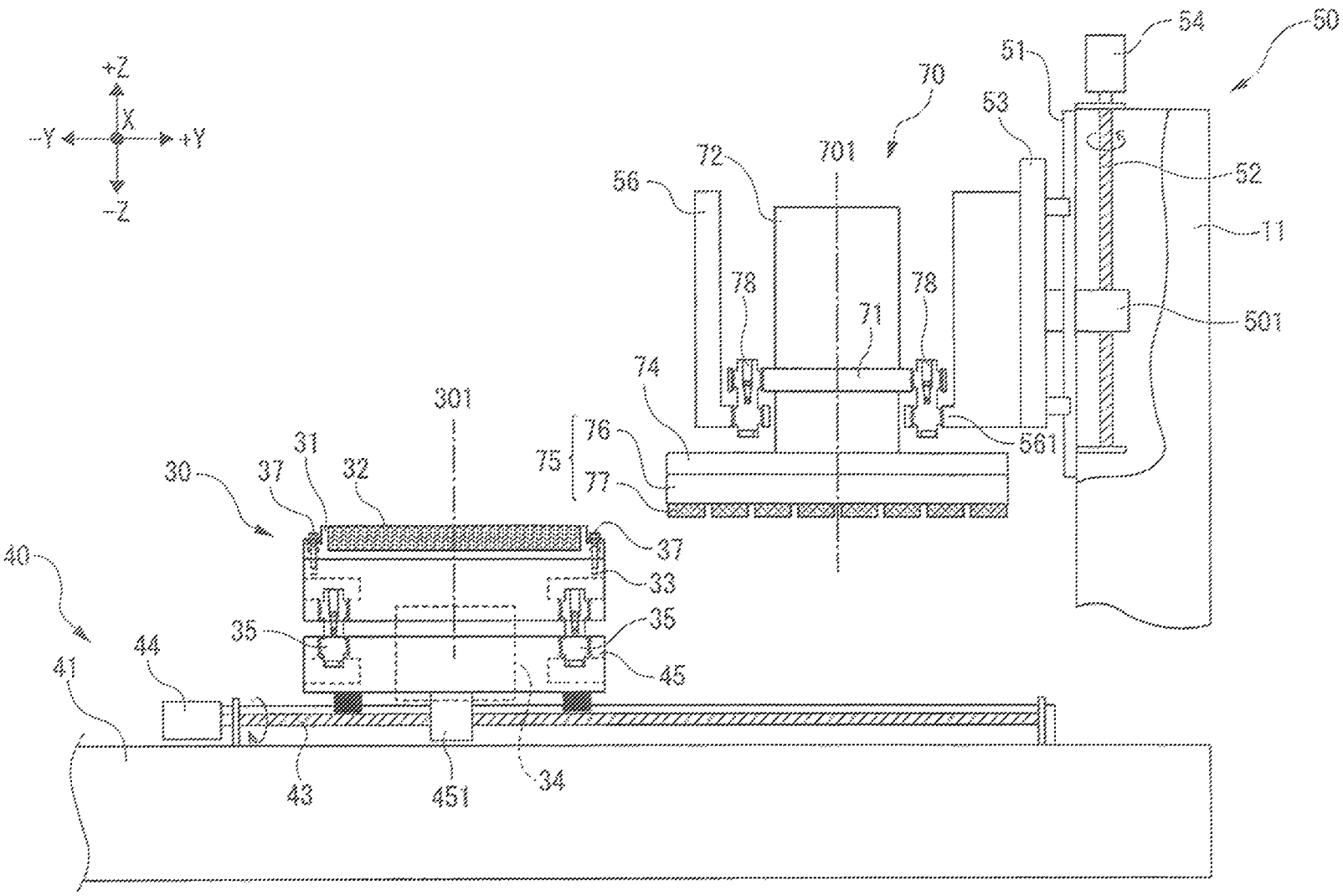
FIG. 2 is a fragmentary cross-sectional view of the grinding apparatus illustrated in FIG. 1.

The main casing 10 has an opening 13 defined in an upper surface thereof. The grinding apparatus 1 includes a holding unit 30 disposed in the opening 13. The holding unit 30 includes a chuck table 31 having a holding surface 32 for holding the wafer 100 thereon and a support member 33 that supports the chuck table 31. As illustrated in FIG. 2, the support member 33 and the chuck table 31 are fastened to each other by screws 37.

The holding surface 32 of the chuck table 31 illustrated in FIG. 1 is held in fluid communication with a suction source, not illustrated, for holding the wafer 100 under suction with the protective tape 105 interposed between the face side 101 of the wafer 100 and the holding surface 32. The holding surface 32 thus holds the wafer 100 on the holding surface 32 of the chuck table 31.

The chuck table 31 with the wafer 100 held on the holding surface 32 is rotatable by a rotating mechanism 34 disposed below the support member 33 about a central table axis 301 (see FIG. 2) extending in the Z-axis directions through the center of the holding surface 32. Therefore, the wafer 100 held on the holding surface 32 is rotated about an axis aligned with the center of the holding surface 32.

As illustrated in FIG. 1, a cover plate 39 is disposed horizontally around the chuck table 31. A bellows cover 12 that are extensible and contractible in the Y-axis directions are coupled to both ends of the cover plate 39. The holding unit 30 is disposed over and supported on a Y-axis moving mechanism 40.

The Y-axis moving mechanism 40 represents an example of a horizontal moving mechanism. The Y-axis moving mechanism 40 operates to move the holding unit 30 and a grinding unit 70, which acts as processing means, on the column 11 relatively to each other in the Y-axis directions parallel to the holding surface 32. According to the present embodiment, the Y-axis moving mechanism 40 operates to move the holding unit 30 relatively to the grinding unit 70 in the Y-axis directions. Another example of the horizontal moving mechanism may be a turntable with a plurality of holding units 30 disposed thereon.

The Y-axis moving mechanism 40 includes a pair of Y-axis guide rails 42 parallel to the Y-axis directions, a Y-axis movable table 45 slidable on and along the Y-axis guide rails 42, a Y-axis ball screw 43 extending parallel to the Y-axis guide rails 42, a Y-axis servomotor 44 connected to an end of the Y-axis ball screw 43, and a support base 41 supporting thereon the Y-axis guide rails 42, the Y-axis ball screw 43, and the Y-axis servomotor 44.

The Y-axis movable table 45 is slidably disposed on the Y-axis guide rails 42. A nut 451 (see FIG. 2) is fixedly mounted on a lower surface of the Y-axis movable table 45 and operatively threaded over the Y-axis ball screw 43.

As illustrated in FIG. 1, when the Y-axis servomotor 44 is energized, it rotates the Y-axis ball screw 43 about its central axis that extends horizontally, causing the nut 451 to move the Y-axis movable table 45 in one of the Y-axis directions along the Y-axis guide rails 42. The support member 33 of the holding unit 30 is disposed on the Y-axis movable table 45. Therefore, when the Y-axis movable table 45 moves in one of the Y-axis directions, the holding unit 30 including the chuck table 31 also moves with the Y-axis movable table 45 in the same Y-axis direction. The Y-axis movable table 45 thus represents an example of base supporting the holding unit 30 thereon.

According to the present embodiment, the holding unit 30 is moved along the Y-axis directions by the Y-axis moving mechanism 40 generally between a wafer placing area as a front area in the −Y direction where the wafer 100 is placed on the chuck table 31 and a grinding area as a rear area in the +Y direction where the wafer 100 on the holding surface 32 is ground.

Furthermore, as illustrated in FIG. 1, the column 11 is erected on the main casing 10 in a rear area in the +Y direction. The grinding unit 70 for grinding the wafer 100 on the chuck table 31 and a grinding feed mechanism 50 are mounted on a front surface of the column 11.

The grinding feed mechanism 50 operates to move the holding unit 30 and the grinding unit 70 relatively to each other in the Z-axis directions, i.e., grinding feed directions, perpendicular to the holding surface 32. According to the present embodiment, the grinding feed mechanism 50 operates to move the grinding unit 70 relatively to the holding unit 30 in the Z-axis directions.

The grinding feed mechanism 50 includes a pair of Z-axis guide rails 51 parallel to the Z-axis directions, a Z-axis movable plate 53 slidable on and along the Z-axis guide rails 51, a Z-axis ball screw 52 extending parallel to the Z-axis guide rails 51, a Z-axis servomotor 54, and a support case 56 mounted on a front surface, i.e., a face side, of the Z-axis movable plate 53 and supporting the grinding unit 70 thereon.

The Z-axis movable plate 53 is slidably disposed on the Z-axis guide rails 51. A nut 501 (see FIG. 2) is fixedly mounted on a rear surface, i.e., a reverse side, of the Z-axis movable plate 53 and operatively threaded over the Z-axis ball screw 52. The Z-axis servomotor 54 connected to an end of the Z-axis ball screw 52.

When the Z-axis servomotor 54 is energized, it rotates the Z-axis ball screw 52 about its central axis that extends vertically, causing the nut 501 to move the Z-axis movable plate 53 in one of the Z-axis directions along the Z-axis guide rails 51. Therefore, when the Z-axis movable plate 53 moves in one of the Z-axis directions, the support case 56 mounted on the Z-axis movable plate 53 and the grinding unit 70 supported on the support case 56 also move with the Z-axis movable plate 53 in the same Z-axis direction. The grinding feed mechanism 50 thus represents an example of a vertically moving mechanism for moving the support case 56 that supports the grinding unit 70 in vertical directions perpendicular to the holding surface 32.

The grinding unit 70 represents an example of processing means. AS illustrated in FIG. 1, the grinding unit 70 includes a spindle housing 71 fixed to the support case 56, a spindle 72 rotatably held by the spindle housing 71, a rotating motor 73 for rotating the spindle 72 about its central axis that extends vertically, a wheel mount 74 attached to a lower end of the spindle 72, and a grinding wheel 75 supported on the wheel mount 74.

The spindle housing 71 is held in the support case 56 and extends in the Z-axis directions. The spindle 72 extends in the Z-axis directions perpendicularly to the holding surface 32 of the chuck table 31, and is rotatably supported by the spindle housing 71.

The rotating motor 73 is coupled to an upper end of the spindle 72. When the rotating motor 73 is energized, it rotates the spindle 72 about a central spindle axis 701 (see FIG. 2) as its central axis extending in the Z-axis directions.

The wheel mount 74 is shaped as a circular plate and fixed to a lower end, i.e., a distal end, of the spindle 72. The wheel mount 74 supports the grinding wheel 75 on a lower surface thereof.

The grinding wheel 75 is of substantially the same diameter as the wheel mount 74. The grinding wheel 75 includes an annular wheel base 76 made of a metal material such as aluminum alloy or the like and an annular array of grindstones 77 fixed to a lower surface of the wheel base 76 along an entire circumferential edge thereof. When the annular array of grindstones 77 is held in contact with the reverse side 104 of the wafer 100 held on the chuck table 31 disposed in the grinding area, and is rotated about its central axis by the rotating motor 73 through the spindle 72, the wheel mount 74, and the wheel base 76, the grindstones 77 grind the reverse side 104 of the wafer 100. The grindstones 77 represent an example of a processing tool. As described above, the grinding unit 70 has the spindle 72, and the spindle 72 supports the grindstones 77 as a processing tool thereon and rotates the grindstones 77 to grind the wafer 100.

As illustrated in FIG. 1, a thickness measuring unit 60 is disposed on the upper surface of the main casing 10 alongside the opening 13. The thickness measuring unit 60 is able to measure the thickness of the wafer 100 held on the holding surface 32 while in contact with the wafer 100.

Specifically, the thickness measuring unit 60 includes a first probe 61 and a second probe 62 that contact the holding surface 32 of the chuck table 31 and the wafer 100, respectively, for measuring the height of the holding surface 32 of the chuck table 31 and the height of the wafer 100. The thickness measuring unit 60 may alternatively include a non-contact rangefinder, i.e., a laser rangefinder, for example, instead of the first probe 61 and the second probe 62.

Furthermore, as illustrated in FIG. 1, a linear scale 65 for measuring the vertical position of the grinding unit 70 is disposed on the column 11. The linear scale 65 includes a reader 66 mounted on the Z-axis movable plate 53 for movement therewith in the Z-axis directions and a scale element 67 disposed on a front surface of one of the Z-axis guide rails 51. When the linear scale 65 is in operation, the reader 66 reads graduations of the scale element 67 to detect the vertical position of the grinding unit 70 as it is moved by the grinding feed mechanism 50.

As illustrated in FIG. 2, the holding unit 30 has holding unit tilt adjusting mechanisms 35. According to the present embodiment, the support member 33 of the holding unit 30 is placed on the Y-axis movable table 45 with the holding unit tilt adjusting mechanisms 35 and a fixed coupling member, not illustrated, interposed therebetween. According to the present embodiment, specifically, the Y-axis movable table 45 supports the holding unit 30 thereon with the holding unit tilt adjusting mechanisms 35 and the fixed coupling member interposed therebetween.

The holding unit tilt adjusting mechanisms 35 include fine adjustment thread assemblies coupling the Y-axis movable table 45 and the holding unit 30 to each other. According to the present embodiment, one fixed coupling member and two holding unit tilt adjusting mechanisms 35 are disposed between the Y-axis movable table 45 and the holding unit 30 at equal angular intervals of 120 degrees, for example, in circumferential directions around the central table axis 301.

The fixed coupling member is provided to couple the Y-axis movable table 45 and the holding unit 30 to each other with a fixed distance kept therebetween at a location where the fixed coupling member is disposed. The holding unit tilt adjusting mechanisms 35 are also provided to couple the Y-axis movable table 45 and the holding unit 30 to each other with a distance kept therebetween. However, the holding unit tilt adjusting mechanisms 35 are capable of adjusting the distance between the Y-axis movable table 45 and the holding unit 30 at locations where the holding unit tilt adjusting mechanisms 35 are disposed.

With the distance adjusting function, the holding unit tilt adjusting mechanisms 35 can vary the tilt of the holding unit 30 with respect to the Y-axis movable table 45, i.e., the tilt of the central table axis 301. The holding unit tilt adjusting mechanisms 35 are thus capable of adjusting the tilt of the holding unit 30 with respect to the grinding unit 70 that is positioned above the holding unit 30 when the wafer 100 on the holding unit 30 is to be ground, and consequently of adjusting the degree of parallelism between the holding surface 32 of the holding unit 30 and the lower surfaces of the grindstones 77 of the grinding unit 70, for example.

Furthermore, each of the holding unit tilt adjusting mechanisms 35 also functions as load detecting means for detecting a load applied to the holding surface 32 of the chuck table 31 in directions perpendicular to the holding surface 32, i.e., in the Z-axis directions, or a load applied to the holding unit 30, when the wafer 100 on the holding unit 30 is ground.

Figure 3:
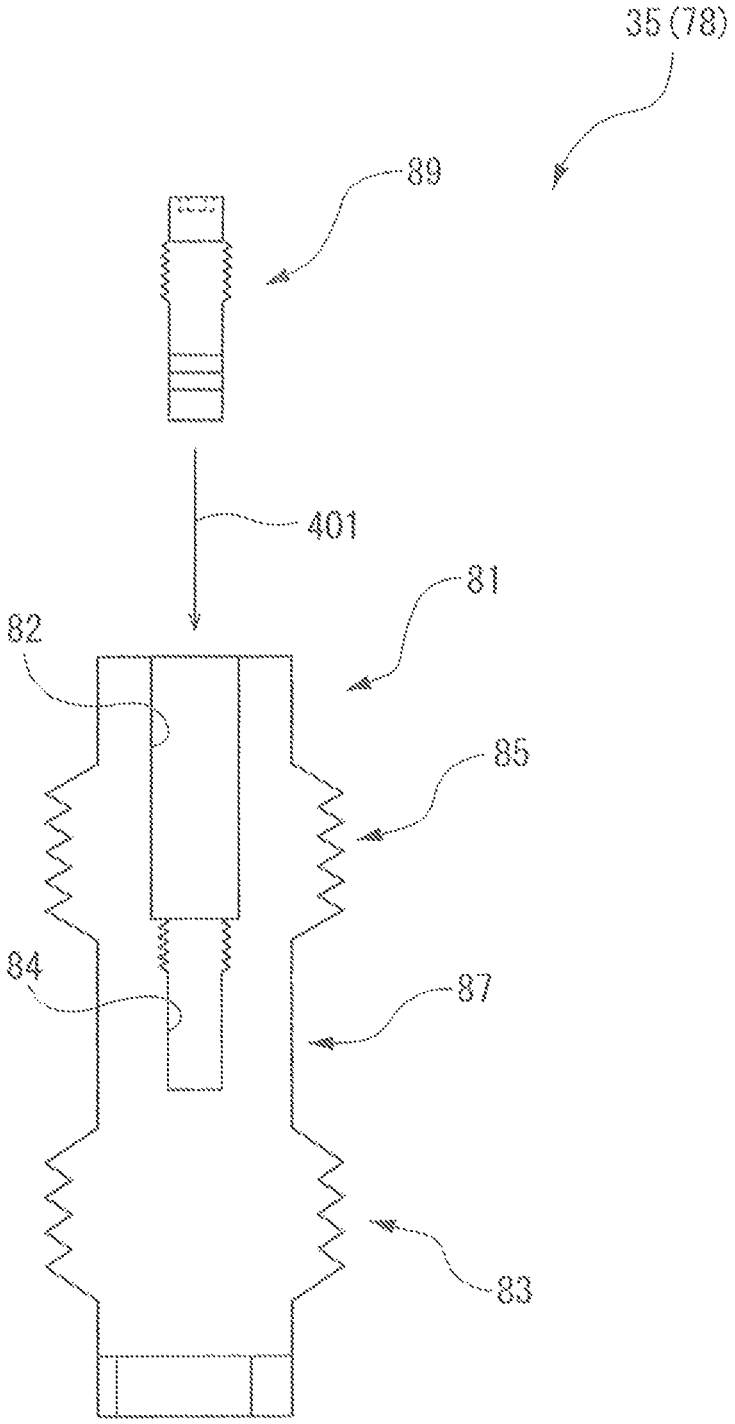
FIG. 3 is a cross-sectional view of a fine adjustment thread assembly incorporated in the grinding apparatus illustrated in FIGS. 1 and 2.

Structural details of the holding unit tilt adjusting mechanisms 35 will be described below. As illustrated in FIG. 3, each of the holding unit tilt adjusting mechanisms 35 includes a stud 81 having a cylindrical shape and a load sensor, i.e., a force sensor, 89 housed in the stud 81.

The stud 81 has on its outer circumferential surface first external threads 83 having a first thread pitch and second external threads 85 having a second thread pitch that is different from the first thread pitch. The second external threads 85 are disposed on an extension of an axial direction, i.e., a longitudinal direction of the stud 81, of the first external threads 83 and axially spaced from the first external threads 83. The stud 81 also has a joint region joining the first external threads 83 and the second external threads 85 that are axially spaced from each other.

Figure 4:
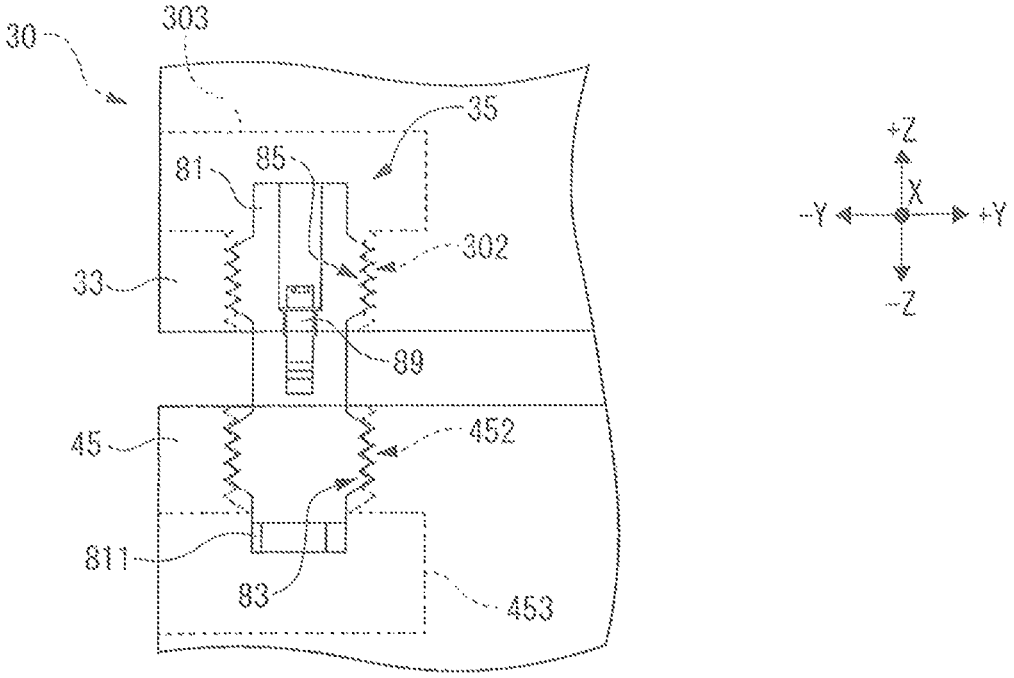
FIG. 4 is a cross-sectional view of a holding unit tilt adjusting mechanism and components in the vicinity thereof.

As illustrated in FIG. 4, the first external threads 83 of the stud 81 can be brought into threaded engagement with table internal threads 452 formed in the Y-axis movable table 45 that is also referred to as a first part. The table internal threads 452 represent an example of first internal threads and have a first thread pitch that is the same as the first external threads 83. A nut, not illustrated, that can be threaded over the first external threads 83 may be added, and the first external threads 83 that are held in threaded engagement with the table internal threads 452 in the first part may be fastened by the nut threaded thereover.

The second external threads 85 can be brought into threaded engagement with holding unit internal threads 302 formed in the support member 33 of the holding unit 30 that is also referred to as a second part. The holding unit internal threads 302 represent an example of second internal threads and have a second thread pitch that is the same as the second external threads 85, but different from the first thread pitch of the table internal threads 452. A nut, not illustrated, that can be threaded over the second external threads 85 may be added, and the second external threads 85 that are held in threaded engagement with the holding unit internal threads 302 in the second part may be fastened by the nut threaded thereover.

For adjusting the tilt of the holding unit 30 with respect to the grinding unit 70, the operator of the grinding apparatus 1 turns the stud 81 of one of the holding unit tilt adjusting mechanisms 35 or the studs 81 of both holding unit tilt adjusting mechanisms 35. When the stud 81 or studs 81 are turned, the first external threads 83 are axially moved with respect to the table internal threads 452, and the second external threads 85 are axially moved with respect to the holding unit internal threads 302. Therefore, the Y-axis movable table 45 and the holding unit 30 are moved with respect to the stud 81 or studs 81.

As described above, the first thread pitch of the table internal threads 452 and the second thread pitch of the holding unit internal threads 302 are different from each other. Therefore, when the stud 81 of one of the holding unit tilt adjusting mechanisms 35 or the studs 81 of both holding unit tilt adjusting mechanisms 35 are turned, the distance that the Y-axis movable table 45 is moved with respect to the stud 81 or studs 81 and the distance that the holding unit 30 is moved with respect to the stud 81 or studs 81 are different from each other. Accordingly, the operator can increase or reduce the distance between the Y-axis movable table 45 and the holding unit 30 at the location where one of the holding unit tilt adjusting mechanisms 35 is disposed or at the locations where both holding unit tilt adjusting mechanisms 35 are disposed by changing the direction in which the stud 81 or studs 81 are turned.

In this manner, the operator can change the distance between the Y-axis movable table 45 and the holding unit 30 at the location where one of the holding unit tilt adjusting mechanisms 35 is disposed or at the locations where both holding unit tilt adjusting mechanisms 35 are disposed by turning one of the holding unit tilt adjusting mechanisms 35 or both holding unit tilt adjusting mechanisms 35 by which the Y-axis movable table 45 and the holding unit 30 are coupled to each other. The operator can thus vary the tilt of the holding unit 30 on the Y-shaft movable table 45 thereby to adjust the tilt of the holding unit 30 with respect to the grinding unit 70.

According to the present embodiment, in order to place the holding unit tilt adjusting mechanisms 35 between the Y-axis movable table 45 and the holding unit 30 and also to turn the studs 81 of the holding unit tilt adjusting mechanisms 35, the holding unit 30 has openings 303 defined therein where the studs 81 have ends exposed (see FIG. 4). In addition, the Y-axis movable table 45 has openings 453 defined therein where the studs 81 have other ends exposed. The other ends of the studs 81 have respective heads 811 over which a tool such as a wrench or the like can be fitted. The operator inserts the tool into the openings 453 and causes the tool to act on the heads 811 for thereby turning the studs 81.

Moreover, as illustrated in FIG. 3, each of the holding unit tilt adjusting mechanisms 35 has an opening 82 defined in an end portion of the stud 81 where the second external threads 85 are formed. The joint portion 87 has a load sensor housing space 84 defined therein behind the opening 82 for housing the load sensor 89 therein.

As illustrated in FIG. 3, the load sensor 89 is inserted into the stud 81 through the opening 82 therein as indicated by the arrow 401 and housed under a compressive load in the load sensor housing space 84 in the joint portion 87. The compressive load is applied as follows. The load sensor 89 has external threads formed on an upper portion thereof that are held in threaded engagement with internal threads formed in an upper portion of the load sensor housing space 84 to press a lower distal end of the load sensor 89 against the bottom of the load sensor housing space 84, thereby applying a compressive load on a piezoelectric element, not illustrated, disposed centrally in the load sensor 89 with respect to the longitudinal directions in which the load sensor 89 extends. The load sensor 89 thus placed in the load sensor housing space 84 is able to measure a load applied to the holding unit tilt adjusting mechanism 35, i.e., the stud 81, in the Z-axis directions that represent longitudinal directions of the stud 81, or in other words, to measure a load imposed on the holding unit 30.

As illustrated in FIG. 2, the grinding unit 70 has processing unit tilt adjusting mechanisms 78. According to the present embodiment, the spindle housing 71 of the grinding unit 70 is placed on a bottom plate 561 (see FIG. 5) of the support case 56 with the processing unit tilt adjusting mechanisms 78 and a fixed coupling member, not illustrated, interposed therebetween. According to the present embodiment, specifically, the support case 56 supports the grinding unit 70 thereon with the processing unit tilt adjusting mechanisms 78 and the fixed coupling member interposed therebetween.

The processing unit tilt adjusting mechanisms 78 include fine adjustment thread assemblies coupling the support case 56 and the grinding unit 70 to each other. According to the present embodiment, one fixed coupling member and two processing unit tilt adjusting mechanisms 78 are disposed between the support case 56 and the grinding unit 70 at equal angular intervals of 120 degrees, for example, in circumferential directions around the central spindle axis 701.

The fixed coupling member is provided to couple the support case 56 and the grinding unit 70 to each other with a fixed distance kept therebetween at a location where the fixed coupling member is disposed.

The processing unit tilt adjusting mechanisms 78 are also provided to couple the support case 56 and the grinding unit 70 to each other with a distance kept therebetween. However, the processing unit tilt adjusting mechanisms 78 are capable of adjusting the distance between the support case 56 and the grinding unit 70 at locations where the processing unit tilt adjusting mechanisms 78 are disposed.

With the distance adjusting function, the processing unit tilt adjusting mechanisms 78 can vary the tilt of the grinding unit 70 with respect to the support case 56, i.e., the tilt of the central spindle axis 701. The processing unit tilt adjusting mechanisms 78 are thus capable of adjusting the tilt of the grinding unit 70 with respect to the holding unit 30 that is positioned below the grinding unit 70 when the wafer 100 on the holding unit 30 is to be ground, and consequently of adjusting the degree of parallelism between the holding surface 32 of the holding unit 30 and the lower surfaces of the grindstones 77 of the grinding unit 70, for example.

Each of the fine adjustment thread assemblies of the processing unit tilt adjusting mechanisms 78 is identical in structure to the fine adjustment thread assembly of the holding unit tilt adjusting mechanism 35 illustrated in FIG. 3. Each of the processing unit tilt adjusting mechanisms 78 includes a stud 81 having first external threads 83, second external threads 85, and a joint portion 87 integrally coupling the first external threads 83 and the second external threads 85 to each other, and a load sensor 89 housed in the stud 81.

Figure 5:
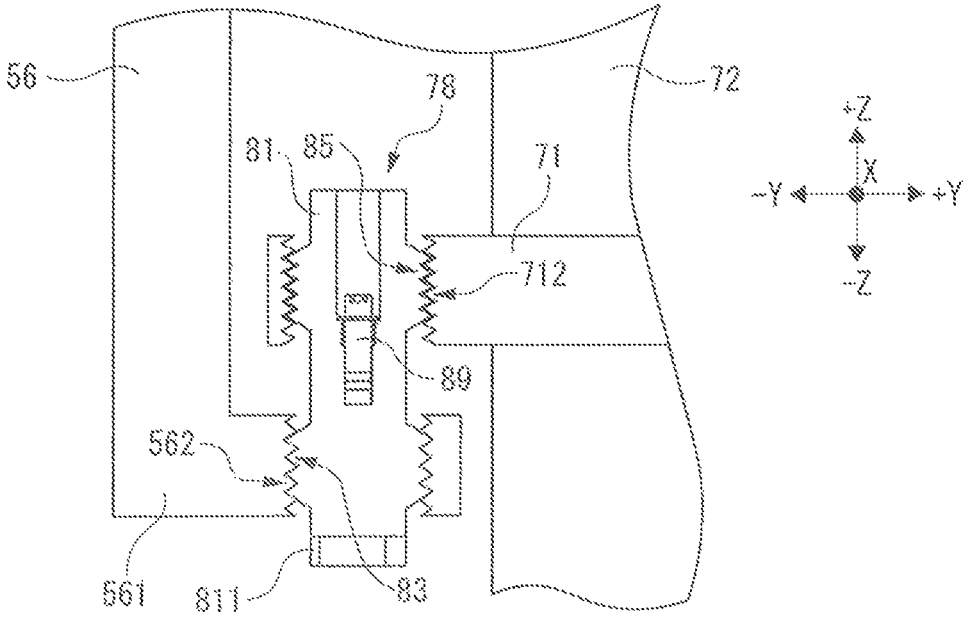
FIG. 5 is a cross-sectional view of a processing unit tilt adjusting mechanism and components in the vicinity thereof.

As illustrated in FIG. 5, the first external threads 83 of the stud 81 can be brought into threaded engagement with support case internal threads 562 formed in the bottom plate 561 of the support case 56 that is also referred to as a first part. The support case internal threads 562 represent an example of the first internal threads and have a first thread pitch that is the same as the first external threads 83. A nut, not illustrated, that can be threaded over the first external threads 83 may be added, and the first external threads 83 that are held in threaded engagement with the support case internal threads 562 in the first part may be fastened by the nut threaded thereover.

The second external threads 85 can be brought into threaded engagement with grinding unit internal threads 712 formed in the spindle housing 71 of the grinding unit 70 that is also referred to as a second part. The grinding unit internal threads 712 represent an example of the second internal threads and have a second thread pitch that is the same as the second external threads 85, but different from the first thread pitch of the support case internal threads 562. A nut, not illustrated, that can be threaded over the second external threads 85 may be added, and the second external threads 85 that are held in threaded engagement with the grinding unit internal threads 712 in the second part may be fastened by the nut threaded thereover.

For adjusting the tilt of the grinding unit 70 with respect to the holding unit 30, the operator turns the stud 81 of one of the processing unit tilt adjusting mechanisms 78 or the studs 81 of both processing unit tilt adjusting mechanisms 78. When the stud 81 or studs 81 are turned, the first external threads 83 are axially moved with respect to the support case internal threads 562, and the second external threads 85 are axially moved with respect to the grinding unit internal threads 712. Therefore, the support case 56 and the grinding unit 70 are moved with respect to the stud 81 or studs 81.

As described above, the first thread pitch of the support case internal threads 562 and the second thread pitch of the grinding unit internal threads 712 are different from each other. Therefore, when the stud 81 of one of the processing unit tilt adjusting mechanisms 78 or the studs 81 of both processing unit tilt adjusting mechanisms 78 are turned, the distance that the support case 56 is moved with respect to the stud 81 or studs 81 and the distance that the grinding unit 70 is moved with respect to the stud 81 or studs 81 are different from each other. Accordingly, the operator can increase or reduce the distance between the support case 56 and the grinding unit 70, i.e., the distance between the bottom plate 561 of the support case 56 and the spindle housing 71 of the grinding unit 70, at the location where one of the holding unit tilt adjusting mechanisms 35 is disposed or at the locations where both holding unit tilt adjusting mechanisms 35 are disposed by changing the direction in which the stud 81 or studs 81 are turned.

In this manner, the operator can change the distance between the support case 56 and the grinding unit 70 at the location where one of the processing unit tilt adjusting mechanisms 78 is disposed or at the locations where both processing unit tilt adjusting mechanisms 78 are disposed by turning one of the processing unit tilt adjusting mechanisms 78 or both processing unit tilt adjusting mechanisms 78 by which the support case 56 and the grinding unit 70 are coupled to each other. The operator can thus vary the tilt of the grinding unit 70 on the support case 56 thereby to adjust the tilt of the grinding unit 70 with respect to the holding unit 30.

The stud 81 has a lower end, which corresponds to the other end of the stud 81 illustrated in FIG. 4, exposed in a space below the bottom plate 561 of the support case 56, i.e., in a gap between the bottom plate 561 and the wheel mount 74 (see FIG. 2). The operator inserts the tool into the gap and causes the tool to act on the head 811 on the exposed end of the stud 81 for thereby turning the stud 81.

In each of the processing unit tilt adjusting mechanisms 78, the load sensor 89 is housed under a compressive load in the load sensor housing space 84 in the joint portion 87 of the stud 81. The compressive load is applied as follows. The load sensor 89 has external threads formed on an upper portion thereof that are held in threaded engagement with internal threads formed in an upper portion of the load sensor housing space 84 to press a lower distal end of the load sensor 89 against the bottom of the load sensor housing space 84, thereby applying a compressive load on a piezoelectric element, not illustrated, disposed centrally in the load sensor 89 with respect to the longitudinal directions in which the load sensor 89 extends. The load sensor 89 thus placed in the load sensor housing space 84 is able to measure a load applied to the processing unit tilt adjusting mechanism 78, i.e., the stud 81, in the Z-axis directions that represent longitudinal directions of the stud 81, or in other words, to measure a load imposed on the grinding unit 70.

Each of the load sensors 89 that are incorporated in the holding unit tilt adjusting mechanisms 35 and the processing unit tilt adjusting mechanisms 78 is capable of measuring both a negative load imposed when the load sensor 89 is expanded and a positive load imposed when the load sensor 89 is compressed. The load sensor 89 can measure a load with an adjustment stud that is compressed when a processing load is applied thereto and that is expanded when no processing load is applied thereto.

According to the present embodiment, as described above, the tilt of the holding unit 30 and the grinding unit 70 with respect to each other can easily be adjusted by turning the holding unit tilt adjusting mechanisms 35 or the processing unit tilt adjusting mechanisms 78, making it simple to adjust the degree of parallelism between the holding surface 32 of the holding unit 30 and the lower surfaces of the grindstones 77. Furthermore, the holding unit tilt adjusting mechanisms 35 and the processing unit tilt adjusting mechanisms 78 can measure loads that are applied to the holding unit 30 and the grinding unit 70 with the load sensors 89 that are incorporated respectively in the holding unit tilt adjusting mechanisms 35 and the processing unit tilt adjusting mechanisms 78.

Each of the holding unit tilt adjusting mechanisms 35 includes a fine adjustment thread assembly threaded in both the Y-axis movable table 45 and the holding unit 30. Similarly, each of the processing unit tilt adjusting mechanisms 78 includes a fine adjustment thread assembly threaded in both the support case 56 and the grinding unit 70. Therefore, even when the distance between members coupled to the holding unit 30 and the grinding unit 70 is increased to adjust the tilt of the holding unit 30 and the grinding unit 70 with respect to each other, the holding unit tilt adjusting mechanisms 35 and the processing unit tilt adjusting mechanisms 78 are less likely to be separated from these members.

According to the present embodiment, consequently, the load sensors 89 of the holding unit tilt adjusting mechanisms 35 and the processing unit tilt adjusting mechanisms 78 are restrained from becoming free of loads. The load sensors 89 are thus capable of appropriately measuring loads applied to the holding unit 30 or the grinding unit 70 even after the tilt of the holding unit 30 and the grinding unit 70 with respect to each other has been adjusted.

According to the present embodiment, while a grinding process performed on the wafer 100 by the grinding apparatus 1 is interrupted, the tilt of the holding unit 30 and the grinding unit 70 with respect to each other is adjusted and a load applied to the holding unit 30 or the grinding unit 70 is measured, so that the load applied before the adjustment of the tilt and the load applied after the adjustment of the tilt can be equalized to prevent the wafer 100 from suffering thickness imperfections after the adjustment of the tilt.

According to the present embodiment, the operator turns the studs 81 of the holding unit tilt adjusting mechanisms 35 and the processing unit tilt adjusting mechanisms 78 using a tool. However, the studs 81 may be turned by a drive source such as an electric motor or the like.

Furthermore, according to the present embodiment, the holding unit 30 includes the two holding unit tilt adjusting mechanisms 35, and the grinding unit 70 includes the two processing unit tilt adjusting mechanisms 78. However, insofar as the tilt of the holding unit 30 and the grinding unit 70 with respect to each other can be appropriately adjusted, the holding unit 30 may include three or more holding unit tilt adjusting mechanisms 35 and the grinding unit 70 may include three or more processing unit tilt adjusting mechanisms 78.

Moreover, according to the present embodiment, the holding unit 30 has the holding unit tilt adjusting mechanisms 35 for adjusting the tilt of the holding unit 30 with respect to the grinding unit 70 and measuring a load applied to the holding unit 30, and the grinding unit 70 has the processing unit tilt adjusting mechanisms 78 for adjusting the tilt of the grinding unit 70 with respect to the holding unit 30 and measuring a load applied to the grinding unit 70. Instead, the grinding apparatus 1 may be arranged to include either the holding unit tilt adjusting mechanisms 35 or the processing unit tilt adjusting mechanisms 78. With this arrangement, it is possible to adjust the tilt of the holding unit 30 and the grinding unit 70 with respect to each other and to measure loads as well.

According to the example illustrated in the present embodiment, the grinding apparatus 1 grinds the wafer 100 by way of infeed grinding with the grinding unit 70 that has the annular array of grindstones 77. Instead, the grinding apparatus 1 may grind a workpiece held on the holding surface 32 of the holding unit 30 by way of creep-feed grinding with the grinding unit 70 that has the annular array of grindstones 77.

Furthermore, the grinding apparatus 1 may have, as a processing unit, a turning unit that has a single-point cutting tool as a processing tool, and the tilt of the turning unit and the holding unit 30 with respect to each other may be changed by the holding unit tilt adjusting mechanisms 35 and/or the processing unit tilt adjusting mechanisms 78 and loads applied to the holding unit 30 and/or the turning unit may be measured by the holding unit tilt adjusting mechanisms 35 and/or the processing unit tilt adjusting mechanisms 78.

Alternatively, the grinding apparatus 1 may have, as a processing unit, a polishing unit that has a disk-shaped or an annular polishing pad, and the tilt of the polishing unit and the holding unit 30 with respect to each other may be changed by the holding unit tilt adjusting mechanisms 35 and/or the processing unit tilt adjusting mechanisms 78 and loads applied to the holding unit 30 and/or the polishing unit may be measured by the holding unit tilt adjusting mechanisms 35 and/or the processing unit tilt adjusting mechanisms 78.

According to the present embodiment, the holding unit tilt adjusting mechanisms 35 each in the form of the fine adjustment thread assembly illustrated in FIG. 3 couple the Y-axis movable table 45 as the first part and the holding unit 30 as the second part to each other, and the processing unit tilt adjusting mechanisms 78 each in the form of the fine adjustment thread assembly illustrated in FIG. 3 couple the support case 56 as the first part and the grinding unit 70 as the second part to each other.

However, the first part is not limited to the Y-axis movable table 45 and the support case 56, and the second part is not limited to the holding unit 30 and the grinding unit 70. Regardless of the kind and nature of the first part and the second part, the fine adjustment thread assemblies that couple the first part and the second part to each other while keeping them spaced apart from each other are capable of adjusting the distance between the first part and the second part and detecting loads applied to the second part.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A fine adjustment thread assembly for coupling a first part and a second part to each other while keeping the first part and the second part spaced apart from each other, adjusting a distance between the first part and the second part, and detecting a load applied to the second part, comprising:

first external threads that are capable of being brought into threaded engagement with first internal threads formed in the first part;

second external threads that are disposed on an extension of an axial direction of the first external threads and axially spaced from the first external threads, that have a thread pitch different from that of the first internal thread, and that are capable of being brought into threaded engagement with second internal threads formed in the second part;

a joint portion by which the first external threads and the second external threads that are spaced from each other are integrally joined to each other; and a load sensor housed in the joint portion under a compressive load.

2. A processing apparatus comprising:

a holding unit for holding a workpiece on a holding surface thereof;

a processing unit including a spindle and a processing tool mounted on the spindle;

a vertically moving mechanism for moving a support case supporting the processing unit thereon in vertical directions perpendicular to the holding surface; and a processing unit tilt adjusting mechanism for adjusting a tilt of the processing unit with respect to the holding unit, wherein the processing unit tilt adjusting mechanism includes a fine adjustment thread assembly for coupling a first part and a second part to each other while keeping the first part and the second part spaced apart from each other, adjusting a distance between the first part and the second part, and detecting a load applied to the second part, the fine adjustment thread assembly includes first external threads that can be brought into threaded engagement with first internal threads formed in the first part, second external threads that are disposed on an extension of an axial direction of the first external threads and axially spaced from the first external threads, that have a thread pitch different from that of the first internal thread, and that are capable of being brought into threaded engagement with second internal threads formed in the second part, a joint portion by which the first external threads and the second external threads that are spaced apart from each other are integrally joined to each other, and a load sensor housed in the joint portion under a compressive load, and the first part includes the support case and the second part includes the processing unit.

* * * * *